US005464109A

United States Patent [19]

Greenwald

[11] Patent Number: 5,464,109

[45] Date of Patent: Nov. 7, 1995

[54] LOCKABLE BOTTLE CAP RETAINER

[76] Inventor: Kenneth Greenwald, 135 Ocean Pkwy., Brooklyn, N.Y. 11218

[21] Appl. No.: 290,164

[22] Filed: Aug. 15, 1994

[51] Int. Cl.[6] ..... B65D 55/14; B65D 17/52

[52] U.S. Cl. ..... 215/207; 215/215; 215/273; 220/210; 220/284; 70/163

[58] Field of Search ..... 215/207, 215, 215/272, 273, 293, 295, 302, 225; 220/210, 262, 315, 284; 292/DIG. 38, 175, 145, 302; 70/163, 164, 173, 169; 137/377, 382, 382.5, 384.2

[56] References Cited

U.S. PATENT DOCUMENTS

| | | | |
|---|---|---|---|
| 1,902,456 | 3/1933 | Matthews | 220/210 X |
| 3,672,403 | 6/1972 | Wilson et al. | 220/315 X |
| 3,930,388 | 1/1976 | Barras | 220/210 X |
| 4,351,446 | 9/1982 | Madden | 220/210 |
| 4,435,966 | 3/1984 | Craig | 220/210 X |
| 4,984,698 | 1/1991 | Stuckey | 220/210 X |

*Primary Examiner*—Allan N. Shoap
*Assistant Examiner*—Nathan J. Nenhouse
*Attorney, Agent, or Firm*—Paul J. Sutton

[57] ABSTRACT

A device to prevent the unauthorized removal of a closure from the mouth of a bottle having an annular ring adjacent to the mouth about the bottle neck. A cap portion fits over the end of the bottle neck and receives within it the annular ring, the bottle mouth and the closure. A locking mechanism housing is formed adjacent the cap and communicates with the bore in the cap by means of a slot. In a first embodiment a pawl means is pivotally mounted in the housing and is spring biased to extend through the slot into the bore. A second embodiment uses a cam controlled spring mechanism to slideably position pawl means in the cap portion or withdraw it therefrom. A tapered leading edge of the pawl means causes the pawl to be displaced into the housing as the annular ring of the bottle passes the pawl. The spring forces the pawl in behind the ring to prevent removal of the cap. A third embodiment uses a sliding grip device in the cap to engage or withdraw locking fingers whose positions are determined by the relative positions of the grip device and the cap.

37 Claims, 10 Drawing Sheets

LOCKABLE BOTTLE CAP RETAINER

BACKGROUND OF THE INVENTION

1. Field of the Invention

The invention pertains to a lockable bottle cap retainer to prevent unauthorized access to the contents of a bottle and more particularly to a device which can be installed over the stopper or cap of a bottle and the bottle neck to prevent unauthorized access to the bottle contents and which can be easily removed by one possessing a suitable key.

2. Prior Art

The prior art contains various devices which can be installed over a bottle neck to prevent access to the contents of a bottle to which the device is installed. These devices are unnecessarily large and complex and the locking means to hold the device in assembly is not very secure.

U.S. Pat. No. 120,363, issued Oct. 31, 1871 to Beal shows two half segments A, $A^1$ hinged together at one end and having locking parts at the other. The locking member is described as a spring on one segment which engages a shoulder on the other.

U.S. Pat. No. 173,061, issued Feb. 1, 1876 to Robards shows a cap A which has two sections $B^2$, one of which is hingedly coupled to each end of middle section $B^1$. When cap A is installed and pressed downwardly to compress spring d, the rim flanges b complete a circle below the shoulder of the neck of the bottle so that it cannot be removed. A key is required to unlock the device so that slide b can be moved and the sections $B^2$ moved outwardly to disengage from the bottle neck.

U.S. Pat. No. 886,723, issued Mar. 3, 1908 to Cumming shows a cap 1 which can be locked upon bottle 2 employing the shoulder 3 on the bottle neck, and fits over the usual cork or stopper 4. Four locking pawls or dogs 12 are arranged to be moved between a withdrawn or unlocked position as shown in FIG. 4 to a locking position under shoulder 3 as shown in FIG. 5. A key 24 controls the position of lock-bolt 21. The key 24 engages arm 25 of lock-bolt 21 and withdraws bolt 21 from ratchet teeth 27. The locking pawl ring 10 can be moved to permit the pawls or dogs 12 to be moved under shoulder 3 or withdrawn therefrom.

Mills, U.S. Pat. No. 1,155,947, issued Oct. 5, 1915, shows a two part cap made of hinged, curved, overlapping plates 14 with integral top extensions 15 which overlay so that the cap can be made to conform to the bottle neck size. A locking ring 16 is placed in one of the recesses $\mathbf{15}^1$ so that it can be placed under lip 12 of the neck 11 of bottle 10. A toothed locking band 18 passes through locking casing 22 where a pawl 24 can be set against teeth 20 on band 18 to lock the cap in place.

Horowitz, U.S. Pat. No. 3,206,955, issued Sep. 21, 1965, shows a bottle lock 10 to be placed on the neck of a capped bottle 12. Locking arms 30, 32 on the interior of body portion 22 are joined at hinge 34. Once the bottle lock 10 is in place the arms 30, 32 are moved so as to be positioned tightly about the neck of bottle 12 under flange 18. A padlock is then passed through the aligned holes 40, 42, 44 or 46.

U.S. Pat. No. 3,526,332, issued Sep. 1, 1970 to Adelberger is directed to a lockable vial which requires an interrupted external tooth pattern 3, 4 (see FIG. 1) and a cap 5 with internal teeth 18 placed to engage teeth 4 of the vial due to the presence of key 1. To remove the cap 5, the key 1 must be removed and the cap 5 rotated to the unthreaded portion 3 of the vial.

U.S. Pat. No. 3,973,687, issued Aug. 10, 1976 to Glick shows a safety cap 22 which only works with a bottle 10 having an internal ring 20. The key 38 operates locking pins 30 to move under internal ring 20 to lock cap 22 in place or withdraw the locking pins 30 to release cap 22.

SUMMARY OF THE INVENTION

The instant invention seeks to overcome the difficulties encountered in the use of prior art devices by providing simple, easy to use lockable bottle cap retainers or devices which can easily be installed upon a capped bottle without the use of tools or keys but which can only be removed by employing the proper key.

The lockable bottle cap retainers or devices of the instant invention employ a solid body member which completely surrounds the bottle cap or cork and at least a portion of the bottle neck to a point below the external annular ring about the bottle neck below the bottle mouth. A first form of locking mechanism housing is joined to the body member's external surface and communicates with the cavity within the body member by means of a slot. Positioned within said slot is a pawl which is mounted to the housing and spring biased to extend beyond the housing into the cavity of the body member to engage the bottle neck below the external annular ring about the bottle neck and thus prevent removal. A passageway in the locking mechanism housing provides access to the pawl operating mechanism which has a keying hub thereon. By inserting a key having a recess complementary to the keying hub, the pawl can be moved against the bias of one or more springs to withdraw the lockable bottle cap retainer from the bottle on which it was installed. The pawl can also be spring biased towards the top of the body member so that it engages the bottle neck at its juncture with the lower face of the neck ring.

In a second form of the lockable bottle cap retainer, the locking mechanism housing is placed in an extension of the solid body making same somewhat taller. The body has a central cavity which terminates at its open end in an inwardly tapered ridge. The locking mechanism is a series of a parallel fingers forming a circle of a diameter greater than the diameter of the bottle external annular ring. At the free ends of the fingers is an outwardly tapered portion on their back surface and inwardly facing tips on their front surface. In the locked position the engagement of the finger's outwardly tapered portion with the inwardly tapered portion of the body causes the inwardly facing tips to form a substantially closed circle of a diameter less than the diameter of the annular ring about the bottle neck below the annular ring locking the device to the bottle.

When the device is unlocked, the finger's outwardly tapered portion engages a portion of the inwardly tapered portion of the body which allows the circle formed by the fingers to expand in diameter to a size greater than the diameter of the annular ring thus withdrawing the inwardly facing tips from under the annular ring permitting the device to be withdrawn from the bottle.

By providing a tapered edge to a portion of the pawl, the engagement of the bottle lip adjacent the bottle's mouth with the tapered pawl edge displaces the pawl from the cavity and into the housing whereby the device can be installed without the use of a key. Similarly, by permitting contact of the neck ring with the locking mechanism fingers to cause the locking fingers to retreat somewhat into the body member, the circle formed at the finger ends is increased to accept the bottle neck therein without the need for tools. It is an object of this invention to provide an improved lockable bottle cap retainer.

It is an object of this invention to provide a lockable bottle cap retainer to prevent unauthorized access to the contents of a bottle to which such device has been applied.

It is another object of this invention to provide an improved lockable bottle cap retainer which can be installed upon a bottle without tools but requires a key to remove such retainer.

It is still another object of this invention to provide an improved lockable bottle cap retainer which can be installed upon a bottle without tools but requires a key having a prescribed end structure so as to permit only such key to release said retainer.

It is still another object of this invention to provide a lockable bottle cap retainer having a spring loaded pawl which engages the underside of a bottle shoulder about its mouth and which can be removed only by use of a key to retract said pawl from said bottle shoulder.

It is yet another object of this invention to provide a lockable bottle cap retainer having a series of fingers to engage the underside of a bottle ring about its neck and whose position is determined by the relative position of such fingers with the housing into which they fit and which can be removed only by use of a key to alter the position of said fingers and permit removal of said retainer from said bottle ring.

Other objects and features of the invention will be pointed out in the following description and claims and illustrated in the accompanying drawings, which disclose, by way of example, the principles of the invention, and the best modes presently contemplated for carrying them out.

BRIEF DESCRIPTION OF THE DRAWING

In the drawings in which similar elements are given similar reference characters.

PREFERRED EMBODIMENTS OF THE INVENTION

Figure 1:
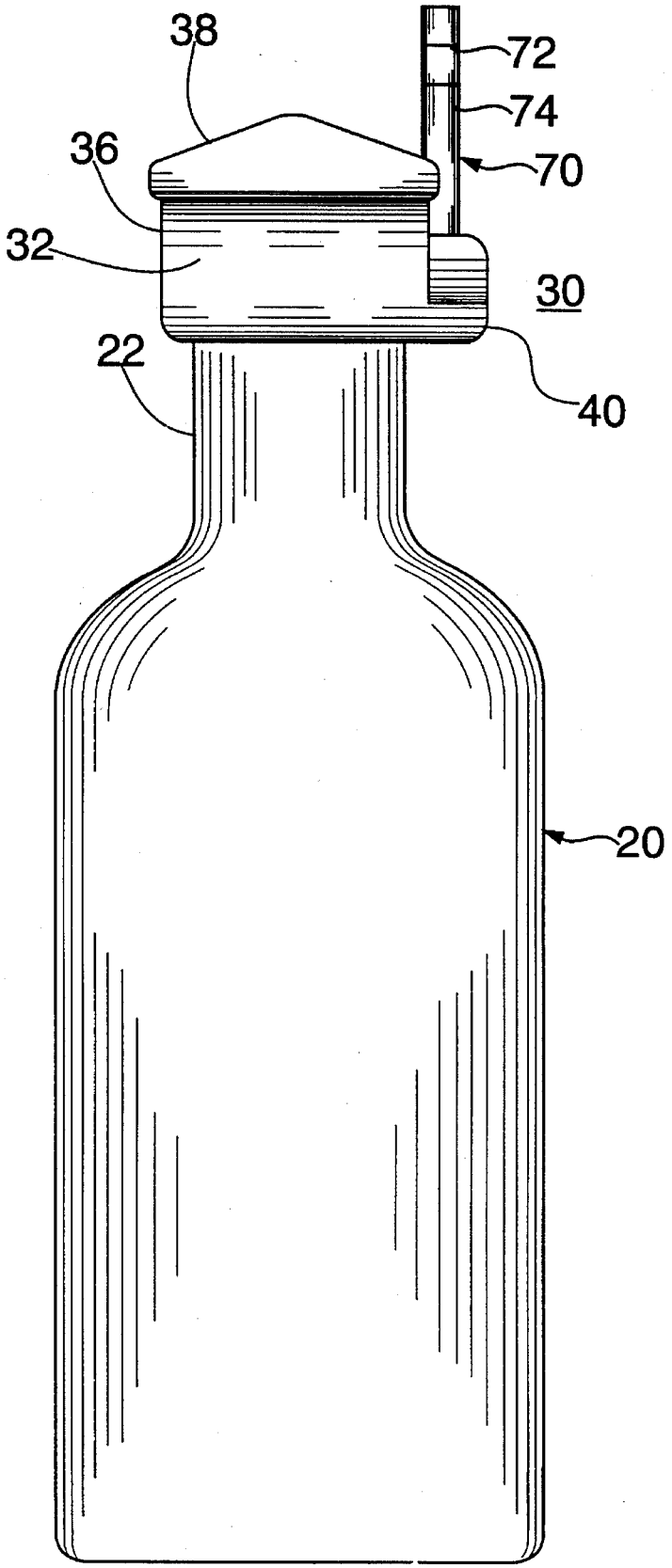
FIG. 1 is a front elevational view of a bottle with a lockable bottle cap retainer constructed in accordance with the concepts of the invention installed thereon.

Turning now to FIGS., 1 to 11, there is shown a lockable bottle cap retainer or device 30 positioned upon a bottle 20 as shown by FIG. 1. Although a bottle of the type often used for liquor is shown, the instant invention is equally applicable to other types of bottles. Bottle 20 has a neck 22 (see FIG. 6) which has a passage therethrough through which liquids can be added to or removed from bottle 20. An annular ring or lip 24 extends about the neck 22 and provides a shoulder 26 adjacent neck 22. A cork 28 fits into the passageway to seal it and extends some distance above lip 24 so it can be gripped and removed or replaced.

Figure 6:
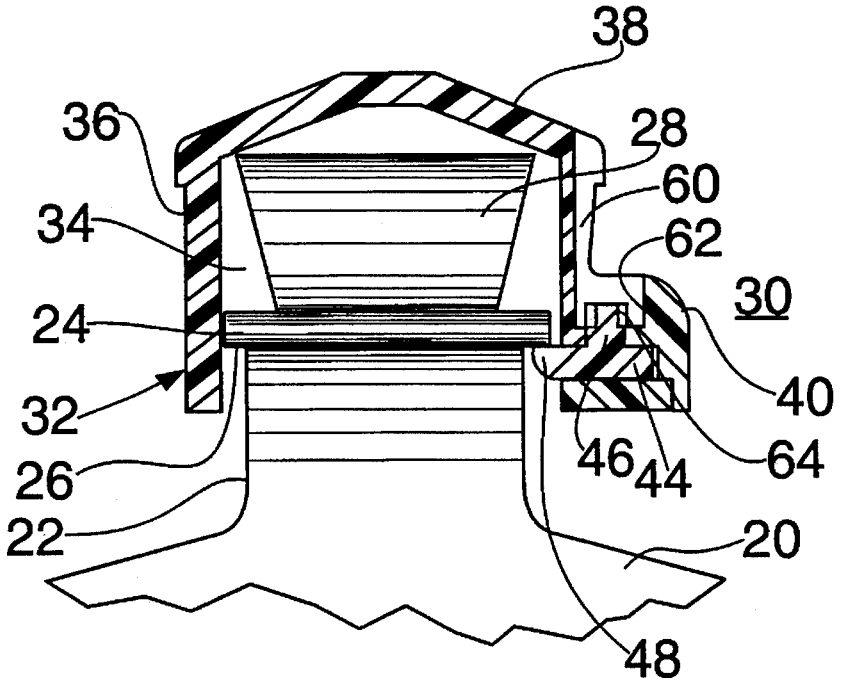
FIG. 6 is a fragmentary front elevation, partly in section, of the retainer of FIG. 1 in the locked condition.

The bottle security system 30 includes a body portion 32 which has a cavity 34 therein as seen in FIG. 6. Body portion 32 has a continuous cylindrical side wall 36 and a top wall 38. Although top wall 38 is shown as generally conical, it could also be made flat or any other convenient shape. The interior diameter of side wall 36 is chosen to be somewhat greater than the outside diameter of the annular ring or lip 24 so that the annular ring or lip 24 can fully enter cavity 34. Because of the locking method used, as set forth below, body portion 32 can be used with a wide range of lip 24 diameters. A series of devices could be made of differing dimensions so that a wide range of bottle sizes can be handled.

Figure 8:
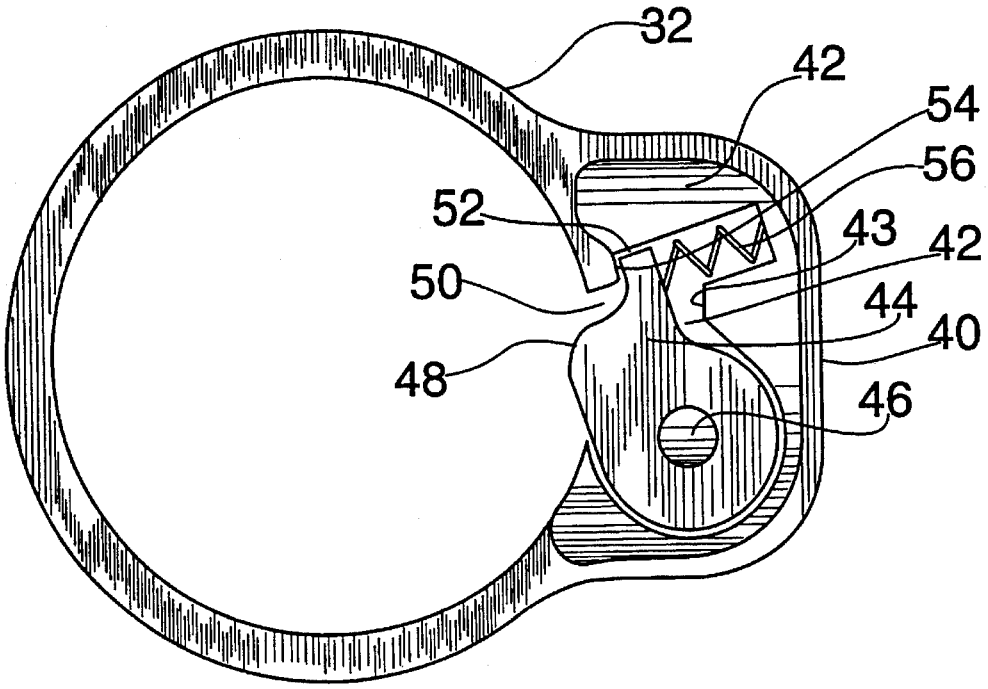
FIG. 8 is a bottom plan view of the lockable bottle cap retainer of FIG. 2.
Figure 9:
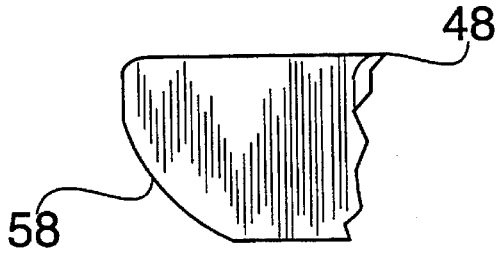
FIG. 9 is a fragmentary side view of a portion of the locking pawl of FIG. 8.

Attached to body portion 32, or molded as part of body portion 32 is locking mechanism housing 40. As best seen in FIG. 8, housing 40 has a recess 42 into which is placed a pawl 44 mounted for rotation about pivot pin 46. A lobe 48 of pawl 44 extends through a slot 50 in side wall 36 of body portion 32. A stop surface 52 of pawl 44 engages a stop 54 under the influence of compression spring 56 to keep lobe 48 of the pawl 44 in cavity 34. Another stop 43 which is located in the recess 42 limits the position of the pawl 44 within the recess when removing the bottle security system. The lower edge of pawl lobe 48 is rounded as at 58 in FIG. 9 so that when the retainer 30 is pushed downwardly upon a bottle lip 24, the pawl 44 is displaced from cavity 34 through slot 50 into recess 42 and causes the compression of compression spring 56. When the pawl 44 is below shoulder 26 and neck 22 is spaced from the walls 36, the compression spring 56 expands and forces the lobe 48 of pawl 44 adjacent shoulder 26 to lock retainer 30 on bottle 20 as shown in FIG. 6.

Figure 2:
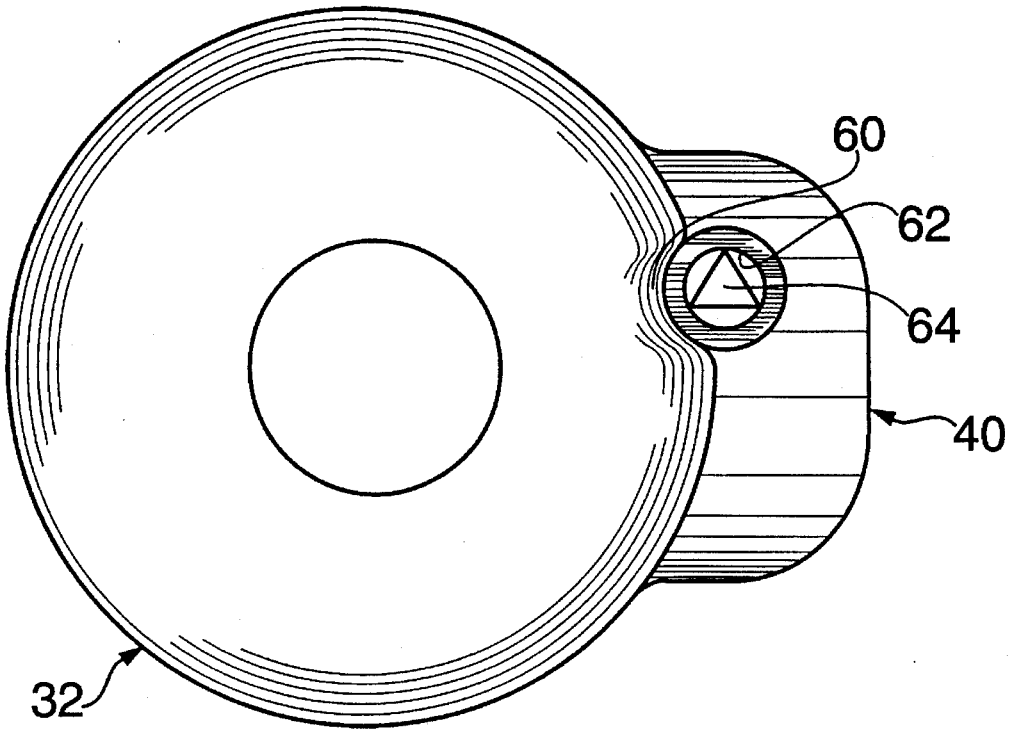
FIG. 2 is a top plan view of the lockable bottle cap retainer of FIG. 1.
Figure 7:
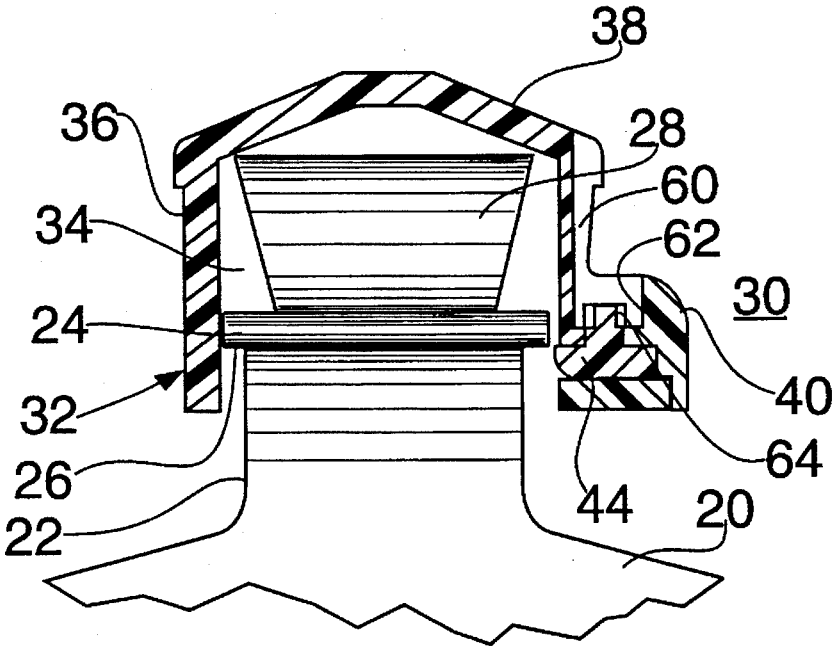
FIG. 7 is a fragmentary front elevation, partly in section, of the retainer of FIG. 1 in the unlocked condition.

A passageway 60 extends in side wall 36 of body portion 32 and communicates with a circular passage 62 in housing 40 (See FIG. 2). Circular passage 62 provides access to a key hub 64 formed on the top surface of pawl 44. By engaging key hub 64 with a suitable tool, the pawl 44 can be rotated about pivot 46 to withdraw lobe 48 from cavity 34 to permit the retainer 30 to be removed from bottle 20, as shown in FIG. 7.

Figure 3:
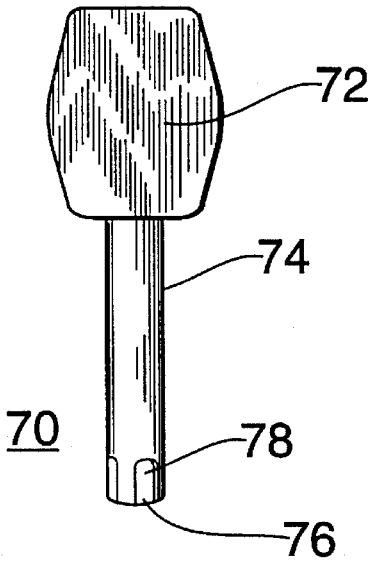
FIG. 3 is a front elevational view of the key of FIG. 1.
Figure 4:
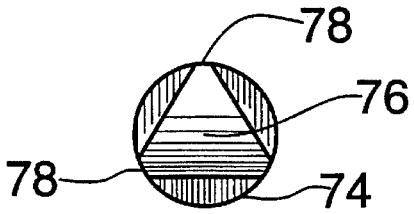
FIG. 4 is a bottom view of the end of the shaft of the key of FIG. 3.
Figure 5:
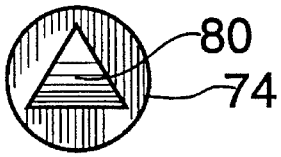
FIG. 5 is a bottom view of the end of the shaft of an alternative form of key which can be employed with the system of FIG. 1.

The key hub 64 shown in FIG. 2 is triangular in shape and the key 70 is made to mate with such triangular shape. As shown in FIGS. 3 to 5, key 70 has a flat tongue portion 72 to permit the key 70 to be gasped and rotated. Extending from tongue portion 72 is a cylindrical shaft 74 which contains, at its free end, a recess 76 which can receive therein the triangular key hub 64. FIG. 4 shows a triangular recess 76 wherein the tips of key hub 64 extend beyond the diameter of shaft 74 to form slots 78 in shaft 74. FIG. 5 shows a recess 80 in shaft 74 which fully contains a smaller triangular key hub.

Figure 10:
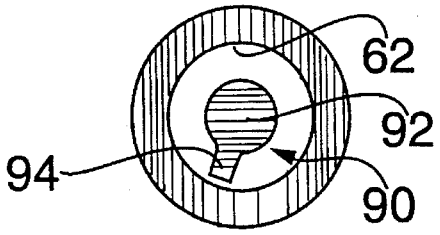
FIG. 10 is a top plan view of a portion of the locking mechanism housing showing a further form of keying hub.
Figure 11:
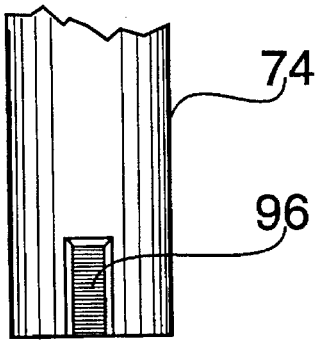
FIG. 11 is a fragmentary front elevational view of the end of a key shaft which is arranged to engage the keying hub of FIG. 10.

The key hub may take any convenient shape so long as it can be engaged by a tool to rotate pawl 44 out of cavity 34. FIG. 10 shows circular passage 62 with a key hub 90 which has a central circular portion 92 with a tab 94 radiating therefrom. The tool shaft 74 will have a central bore (not shown) to receive portion 92 and a slot 96 from the central bore to the surface of shaft 74 to receive tab 94 (see FIG. 11).

Turning to FIGS. 12 to 15 another form of lockable bottle cap retainer 100 using an enlarged pawl 110 is shown. The enlarged pawl 110 is required where the bottle has a very small ring about its neck or on wine bottles where the ring is rounded and does not have pronounced shoulders. With such a bottle the more limited grip of pawl 44 may be insufficient. Enlarged pawl 110 (see FIG. 15) has a wide, crowed front edge 112 to engage more of the neck of a bottle on which it is placed. A tapered portion 114 allows the pawl 110 to be displaced into lock mechanism housing 104 so the retainer 100 can be installed on a bottle without tools. Pawl 110 has a wide blade portion 116 at one end of which is formed the crowed front edge 112 and at the other a narrower extension 118. The transition from blade portion 116 to extension 118 provides two shoulders 120. A perpendicular rib 122 rises at the rear end of extension 118 and has a small recess 124 approximately at its midpoint. A further perpendicular rib 126 extends across a portion of the width of extension 118 approximately in line with shoulders 120. An elongate slot 128 extends generally between fibs 122 and 126. A stop pin 130 is placed adjacent recess 124 in rib 122.

The lock mechanism housing 104 (see FIG. 14) has a recess 106 to accommodate the full range of travel of the pawl 110. Recess 106 has a slot 108 through which pawl 110 can extend, two shoulders 107 and an aperture 109. Pawl 110 is placed in recess 106 and a pin 132 passes through slot 128 into aperture 109. Compression springs 134 are located between shoulders 107 on the housing 104 and 120 on the pawl 110. These compression springs 134 tend to extend pawl 110 beyond slot 108 to engage a bottle neck placed in the retainer 100.

Figure 12:
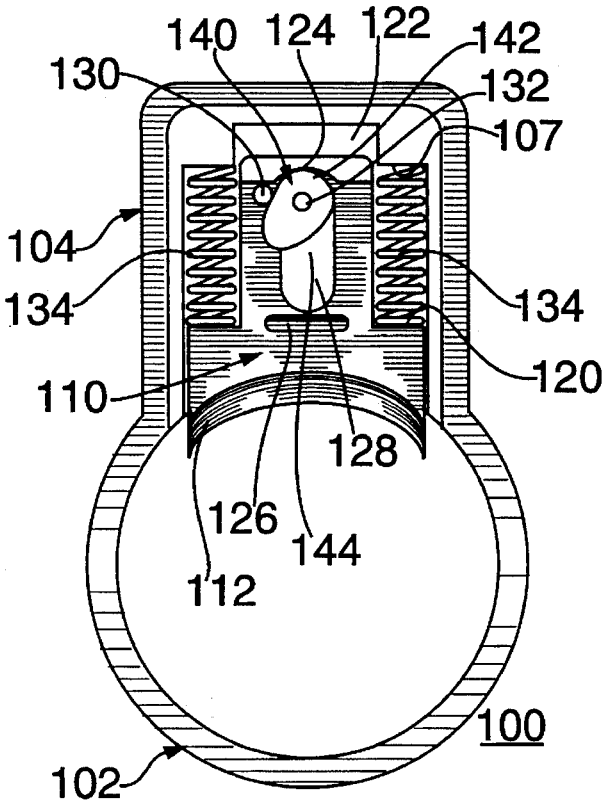
FIG. 12 is a bottom plan view of a further embodiment of a lockable bottle cap retainer
Figure 13:
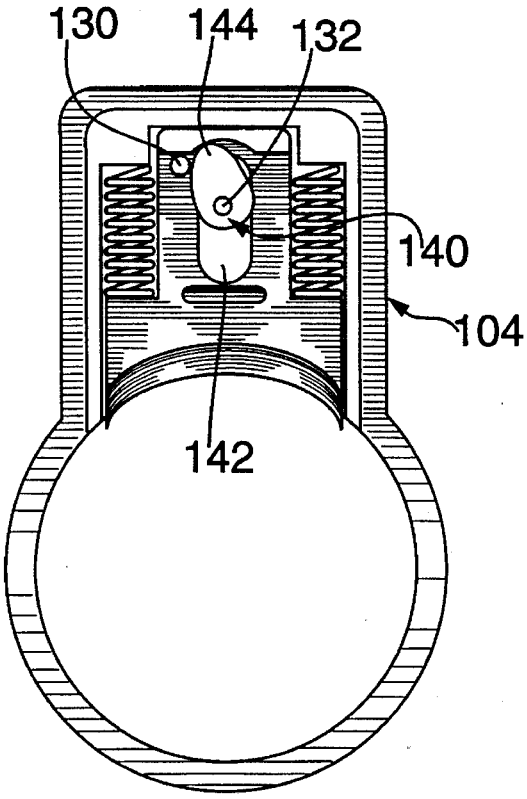
FIG. 13 is a fragmentary bottom plan view of a portion of the device of FIG. 12 showing the operating cam in the pawl fully retracted position.
Figure 14:
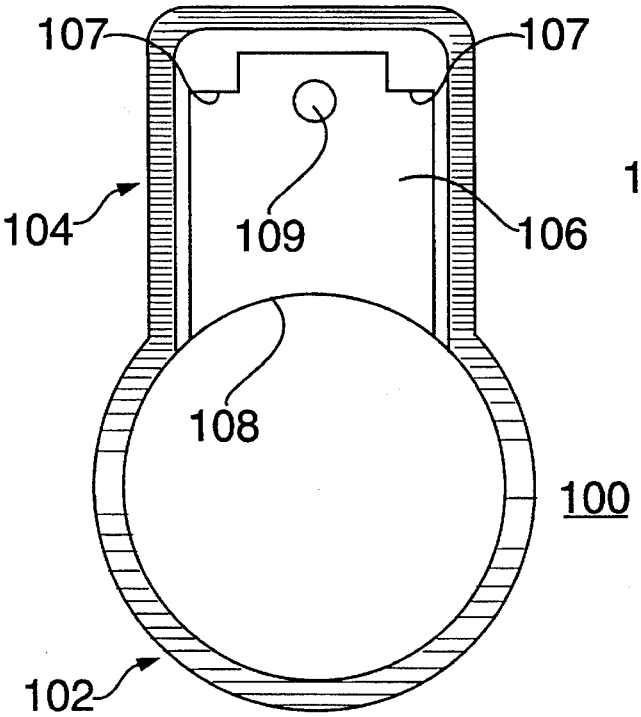
FIG. 14 is a fragmentary bottom plan view of the base of the locking mechanism of FIG. 12 with the pawl and return springs removed.
Figure 15:
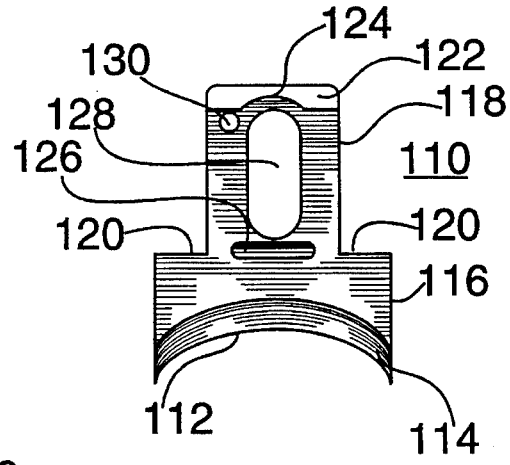
FIG. 15 is a bottom plan view of the pawl of FIG. 12.

A cam 140 has short lobe 142 adjacent pin 132 which when it engages recess 124 in rib 122 (as shown in FIG. 12) allows the pawl 110 to extend fully out of housing 104 and engage the bottle neck. Cam 140 travel is limited by stop pin 130. As a suitable key engages the key hub (not shown)the cam 140 is turned in a counter clockwise direction to bring the long lobe 144 into contact with recess 124 in rib 122 (as shown in FIG. 13) and the pawl 110 is urged out of its contact with the bottle neck and into housing 104 and causes springs 134 to compress. When the key, which may take a shape as shown in FIG. 3 and have recesses such as shown in FIG. 4, 5 or 10 is removed from its corresponding key hub (not shown), the compression springs 134 will expand and force the pawl 110 out of the housing 104. In this condition, device 100 can be placed on a bottle neck and pushed downwardly towards the bottle bottom. The tapered area 114 will urge the pawl 110 out of the way into housing 104. As soon as the neck narrows, the pawl 110 under the influence of springs 134 will take its lock position in engagement with the bottle neck.

Another form of lockable bottle cap retainer 400, shown in FIGS. 24 to 34, is particularly useful for wine and other bottles 20 with small, rounded annular rings 402 without pronounced shoulders. The retainer 400 is also useful to cover a wider range of annular ring placements than with the systems previously described. This is so because an extra spring member has been added to urge the locking pawl upwardly towards the bottle's mouth. This added spring member increases greatly the possibility of the pawl engaging the juncture between the bottle neck 22 and the rounded annular ring 402. Lockable bottle cap retainer 400 has a body member 404 with a central cavity 406 therein. A locking mechanism housing 408 is formed integrally with body member 404. A cam 414, is mounted on a first surface of rotatable support 416, said cam 414 when in a first position, in conjunction with spring mechanism 420 permits pawl 412 to enter cavity 406 through a slot 410 and move along bottle neck 22 until it engages the juncture between the neck 22 and annular ring 402. The cam 414 when moved to its second position withdraws pawl 412 from cavity 406 into housing 408 through slot 410 and causes the spring components of the spring mechanism 420 to be compressed, as will be more fully described below. A key hub 418 is mounted on the other side of rotatable support 416 and is engaged by a suitable key inserted through passageway 422, to position the cam 414 in its desired position.

Figure 25:
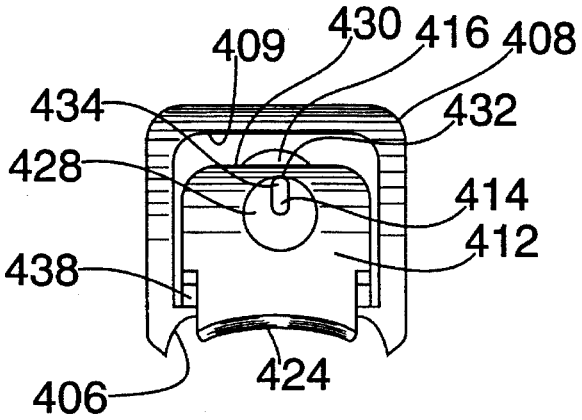
FIG. 25 is a fragmentary bottom view of the locking mechanism housing and the locking pawl of FIG. 24.
Figure 30:
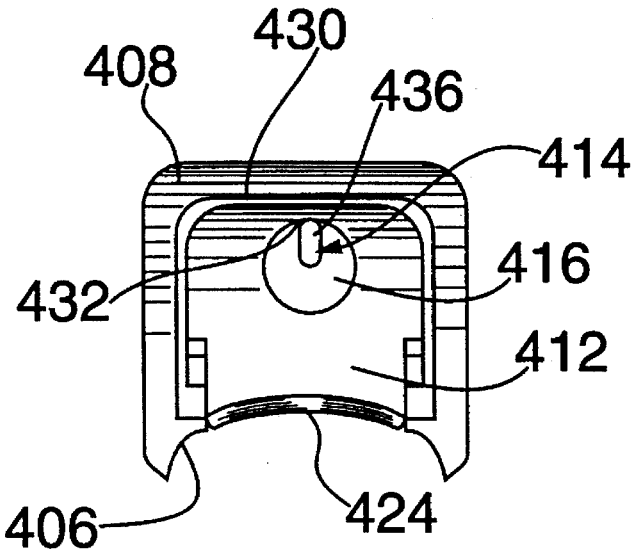
FIG. 30 is similar to FIG. 25 but shows the pawl in its retracted, unlocked position.
Figure 31:
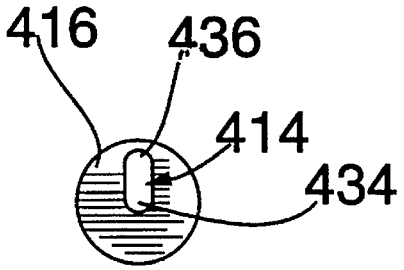
FIG. 31 is a bottom plan view of the operating cam of the device of FIG. 24.

Turning now to FIG. 25, the bottom of pawl 412 is shown. Pawl 412 has a curved front edge 424 which tapered as at 426 (see FIG. 24) and a generally straight rear edge 430. An aperture 428 is placed adjacent rear edge 430. The wall defining the portion of aperture 428 adjacent rear edge 430 is a cam bearing surface 432. The cam 414 is shown in FIG. 31 mounted upon rotatable support 416 and having a short cam end 434 and a long cam end 436. The terms short cam end and long cam end refer to the distance between the cam end and the center of rotatable support 416. As shown in FIG. 25, the short cam end 434 is engaging cam bearing surface 432 permitting the pawl 412 to extend into the cavity 406. In FIG. 30 with the long cam end 436 engaging cam beating surface 432, the pawl 412 is fully retracted into housing 408.

Figure 26:
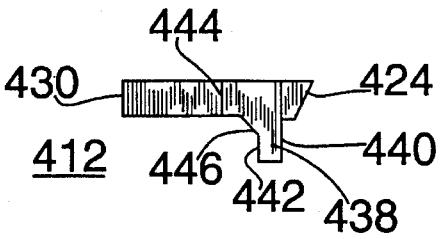
FIG. 26 is a side view of the pawl of FIG. 25.

Adjacent front edge 424 of pawl 412 are two upstanding arms 438, one to each side (See FIG. 26). The front surfaces 440 of these arms are generally perpendicular to the top and bottom surfaces of pawl 412. The rear surfaces of arms 438 are made up of surfaces 442 and 444 which are parallel with front surface 440 and an inclined surface 446 between them.

Figure 27:
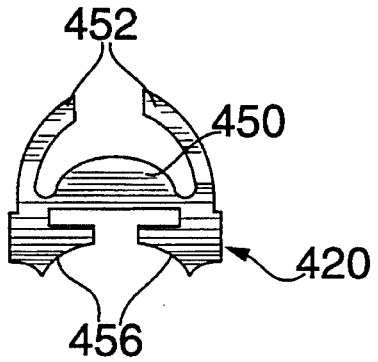
FIG. 27 is a bottom plan view of the spring mechanism of the device of FIG. 24.

The bottom surface of spring mechanism 420 is shown in FIG. 27. Mechanism 420 is made of resistent material such as thermoset or thermoplastic materials. Mechanism 420 has a central body 450 from which extend two curved arms 452 which due to their resiliency and thickness act as a spring component. The two crowed arms 452 act upon the inner surface 409 of housing 408 to urge the pawl 412 through slot 410 into cavity 406. As will be described below, when cam 414 withdraws pawl 412 into housing 408 the spring component made up of arms 452 are compressed so that they can move pawl 412 back into cavity 406 when cam 414 permits.

Figure 28:
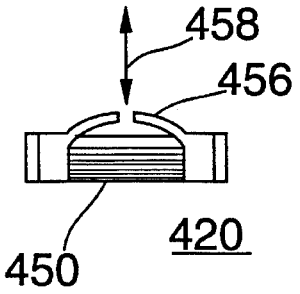
FIG. 28 is a front view of the spring mechanism of FIG. 27.

Adjacent central body portion 450 remote from arms 452 are a second set of arms 456 formed by separating them from body portion 450 by a slot 454 and thinning of the body portion 450 formed into the arms. Arms 456, as is better seen in FIG. 28 are bowed in such a manner as to provide a spring action along an axis perpendicular to main body portion 450. Arms 456 will act along the double arrow headed line of action 458.

Figure 29:
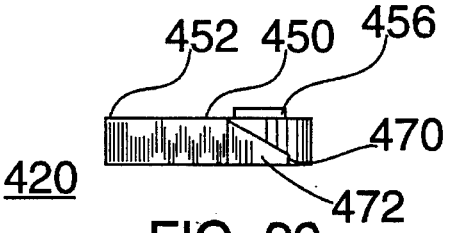
FIG. 29 is a side view of the spring mechanism of FIG. 27.

FIG. 29 shows a side view of the spring mechanism 420. At each side of mechanism 420 are positioned cam surfaces including a vertical surface 470 and an inclined surface 472 complementary to inclined surface 446 of pawl 414.

Returning to FIG. 24, with the short cam end 434 engaged with cam bearing surface 432, the arms 452 urge spring mechanism 420 towards the slot 410. The engagement between surface 470 of mechanism 420 and surface 442 of the pawl 412 also advance pawl 412 towards slot 410. As the spring arms 456 act upon the underside of pawl 412, they cause pawl 412 to rise and take the position shown in FIG. 24. The lifting of pawl 412 causes inclined surfaces 472 of mechanism 420 to engage inclined surface 446 of pawl 412 and complete the injection of pawl 412 into cavity 406. If lockable bottle cap retainer 400 were in a locked position as described but with no bottle in cavity 406, the retainer 400 could be applied to such bottle by placing it over the bottle end and pressing down, since such action would displace the pawl 412 until the annular ring 402 was past the pawl 412 at which time it could return to the position shown. Thus the retainer 400 can be installed without a key or other tool.

Figure 32:
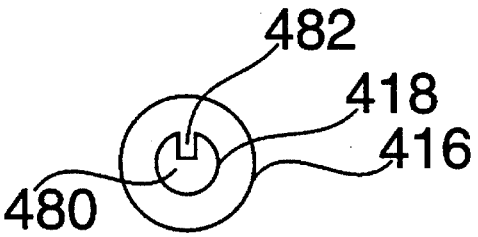
FIG. 32 is a top plan view of the key hub of the device of FIG. 24
Figure 33:
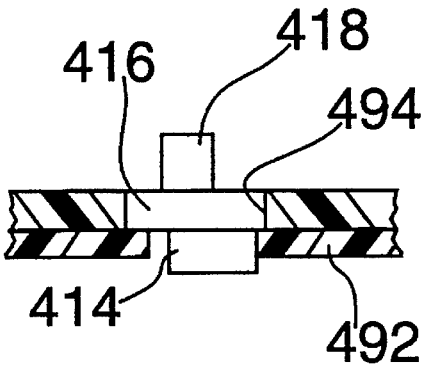
FIG. 33 is a side elevational view, partly in section, of the cam and key hub and supporting structure.
Figure 34:
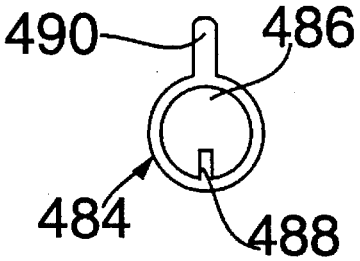
FIG. 34 is an end view of the key socket to match the key hub of FIG. 32.

To remove device 400, a key (not shown) is inserted into passageway 422 to engage key hub 418. The key can be any of the types shown in FIGS. 3 to 5, 10 or 11 or as shown in FIGS. 32 and 34. Key hub 418 is shown with a solid central column 480 with a radial slot 482 extending partway to the center of the column 480. The end of the key 484 shown in FIG. 34 has a generally hollow area 486 to receive column 480 and a radial rib 488 to mate with radial slot 482. Key 484 has an additional rib 490 on the exterior of its body to mate with a complementary slot (not shown) adjacent passageway 422, permitting key 484 to enter passageway 422 only one way and aligning rib 488 with slot 482. Rotatable support 416 is supported on members 492 and contained within recess 494 as shown in FIG. 33, permitting the rotatable support 416 to be rotated by the key 484 acting upon key hub 418 to rotate cam 414.

To remove the retainer 400 from bottle 20, key 484 is inserted into passageway 422 and the rib 490 is aligned with the adjacent slot (not shown). The rib 488 enters slot 482 and the remainder of column 480 enters cavity 486 in key 484. The key hub 418 is rotated to bring the long cam end 436 into engagement with cam beating surface 432. The engagement of inclined surface 446 of the pawl 412 with inclined surface 472 of the spring mechanism 420 forces the mechanism 420 to the left in FIG. 24, and starts to compress spring arms 452 and 456 which permits pawl 412 to take a position on the mechanism 420. The final movement of spring mechanism 420 to the left is caused by the engagement of faces 442 of arms 438 with faces 470 of mechanism 420. The pawl 412 moves under a wall section 411 which keeps the spring fingers 456 from separating the pawl 412 and spring mechanism 420 at this point.

The lockable bottle cap retainers 30, 100 and 400 add little to the overall height of the bottle but they do add measurably to the bulk at the bottle neck. A lockable bottle cap retainer 200 shown in FIGS. 16 to 19 increases the diameter of the bottle neck to a small degree and increases to a minimal extent the height of the bottle. Lockable bottle cap retainer 200 has a circular body portion 202 having an open top 204 and a open bottom 206. The external surface 208 between top 204 and bottom 206 is flat while the interior surface 210 is flat from top 204 towards bottom 206, and has an inwardly tapered portion 212 adjacent bottom 206.

The open top 204 is closed with a cap 220 which can be permanently attached at its inner edge to the top of body portion 202 as by adhesives, sonic welding or the like. Cap 220 (see FIG. 17) has a central recess 222 and a through bore 224. Set in the bottom of recess 222 are two generally triangular shaped cam surfaces 226 set 180° apart and separated along the flat bottom of central recess 222. Placed in recess 222 is a rotor 230 having a central bore 232 therethrough. On the bottom surface of rotor 230 are two generally triangular cam surfaces 234 set 180° apart and separated along the flat bottom of rotor 230. Four recesses 238 (only two of which are visible in the figures) extend inwardly from top surface 236 and are set 90° apart from each other and arranged to receive, two at a time, the prongs 248 of key 240 shown in FIG. 16. Key 240 has a finger grip portion 244 at one end of body 242 and a base 246 at the other. Two prongs 248 extend from base 246 and are spaced to engage recesses 238 separated by 180°. By turning the key 240 with prongs 248 engaging recesses 238 the rotor 230 can be moved to one position where cams 234 of rotor 230 are atop cams 226 of cap 22 (see FIGS. 16 and 17) and top surface 236 of rotor 230 is raised above top surface 228 of cap 220 or to a second position, 90° rotation from the first, where the cams 234 of rotor 230 rest between the cams 226 of cap 220 (see FIGS. 18 and 19) and top surface 236 of rotor 230 is aligned with top surface 228 of cap 220. The first position is again reached for a further 90° rotation of key 240 and the second position occurs as the key 240 is rotated a further 90°.

The grip member 250 is made of a circular top portion 252 from which depend a number of fingers 254 having a generally cylindrical exterior but end in an inwardly tapered portion 260 adjacent free ends 256. The interior surface is similarly generally cylindrical except for the inwardly tapered tips 264 adjacent their free ends 256. The grip member 250 is made of a resilient plastic so that the circle described by the tips 264 can be decreased by the increased interaction of the inwardly tapered portion 260 of fingers 254 with inwards tapered portion 212 of body portion 202 and the resiliency of the fingers 254 returns the tips 264 to their original positions opening the circle described upon a decrease in the interaction of the fingers with the body portion.

The grip member 250 is attached to pin 270 at first end 272. Pin 270 has a rim 274 at its opposite end which rides in a bore enlargement 237 of rotor 230 and is covered over by the central portion of top surface 236. Thus as the rotor 230 is rotated the pin 270 does not rotate nor does grip member 250. However, as the rotor 230 moves towards and away from the cap 220, this translation motion is applied to the grip member 250.

Figure 16:
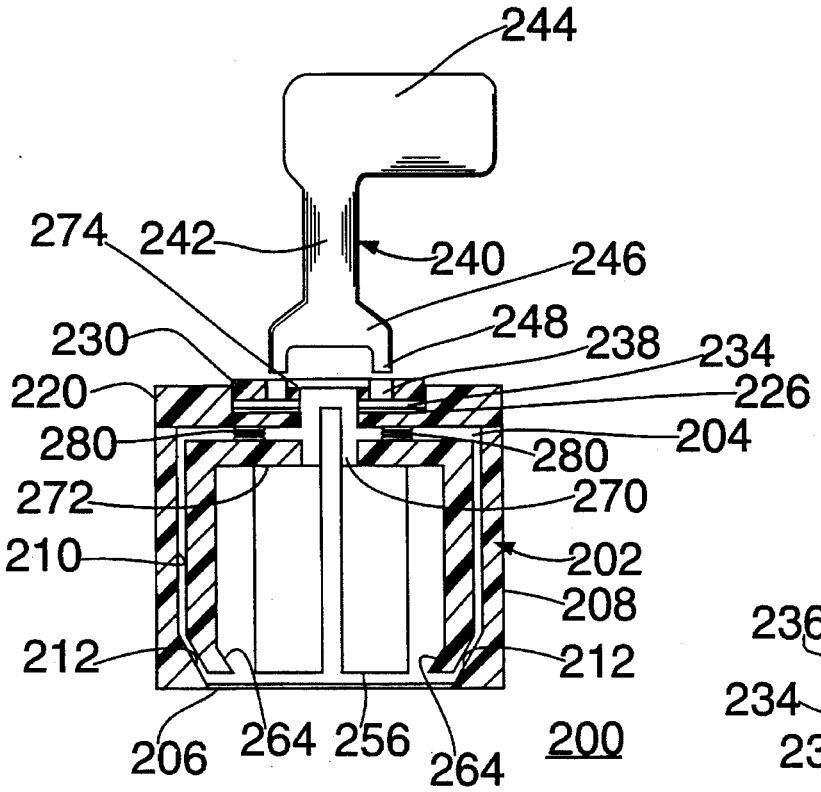
FIG. 16 is a side elevational view, partially in section, showing yet another embodiment of a lockable bottle cap retainer constructed in accordance with the concepts for the invention and shown in its withdrawn condition.
Figure 17:
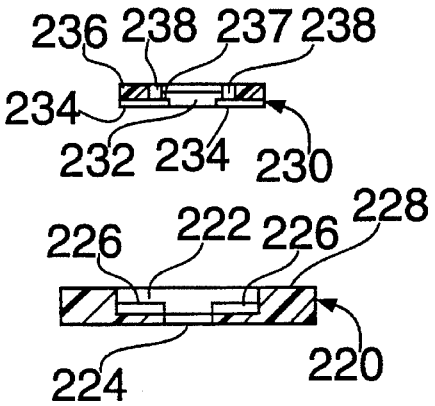
FIG. 17 is an exploded side view of two components of the retainer of FIG. 16 which permits withdrawal of the retainer from a bottle.

As shown in FIGS. 16 and 17, when cams 234 of rotor 230 are on cams 226 of cap 220, rotor 230 surface 236 is displaced above surface 228 and the pin 270 pulls the grip member 250 further into body portion 202 and compresses compression springs 280. This reduces the engagement of tapered portion 260 of fingers 254 with tapered portion 212 of body portion 202 permitting the fingers 254 to return to their normal position. In this position the inwardly extending tips 264 are no longer under the bottle neck ring and the device 200 can be withdrawn. Any downward force on tips 264 by the bottle neck rib will merely cause fingers 254 to be further displaced towards body portion 202.

Figure 18:
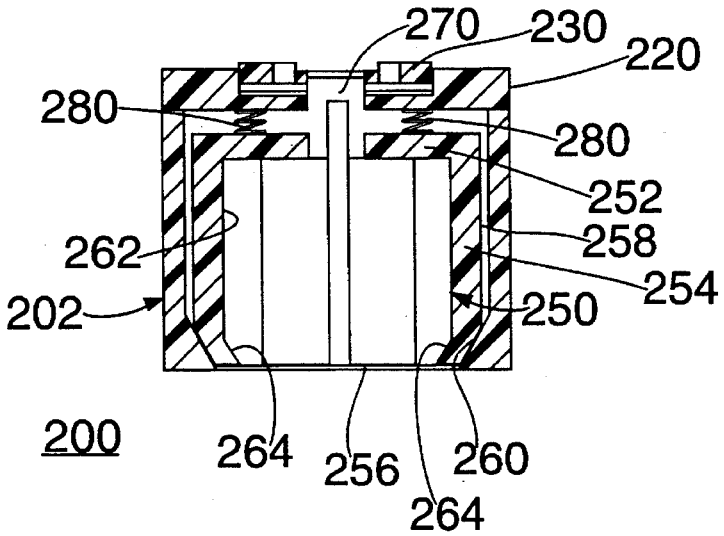
FIG. 18 is a side elevational view of the device of FIG. 16 shown in its locked condition.
Figure 19:
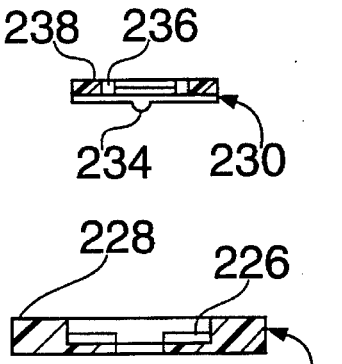
FIG. 19 is an exploded side view of the components of FIG. 17 rotated into a position to permit the system of FIG. 18 to be in its locked condition.
Figure 21:
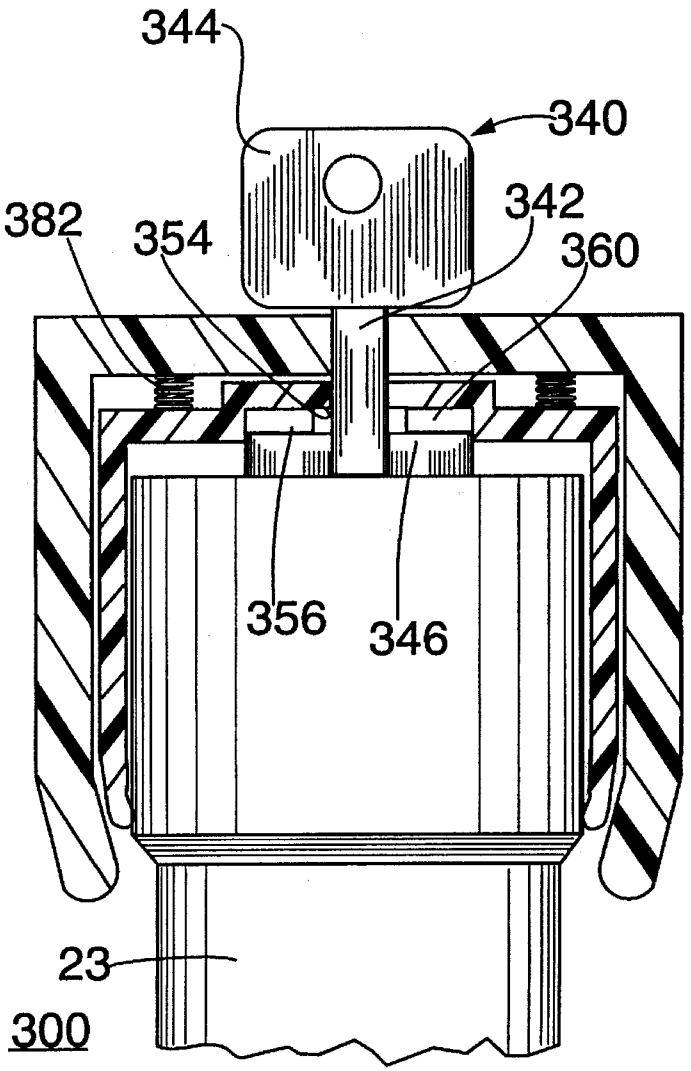
FIG. 21 is a side elevational view, in section, of the device of FIG. 20 but shown in its unlocked condition so that the lockable bottle cap retainer can be removed from the bottle.
Figure 20:
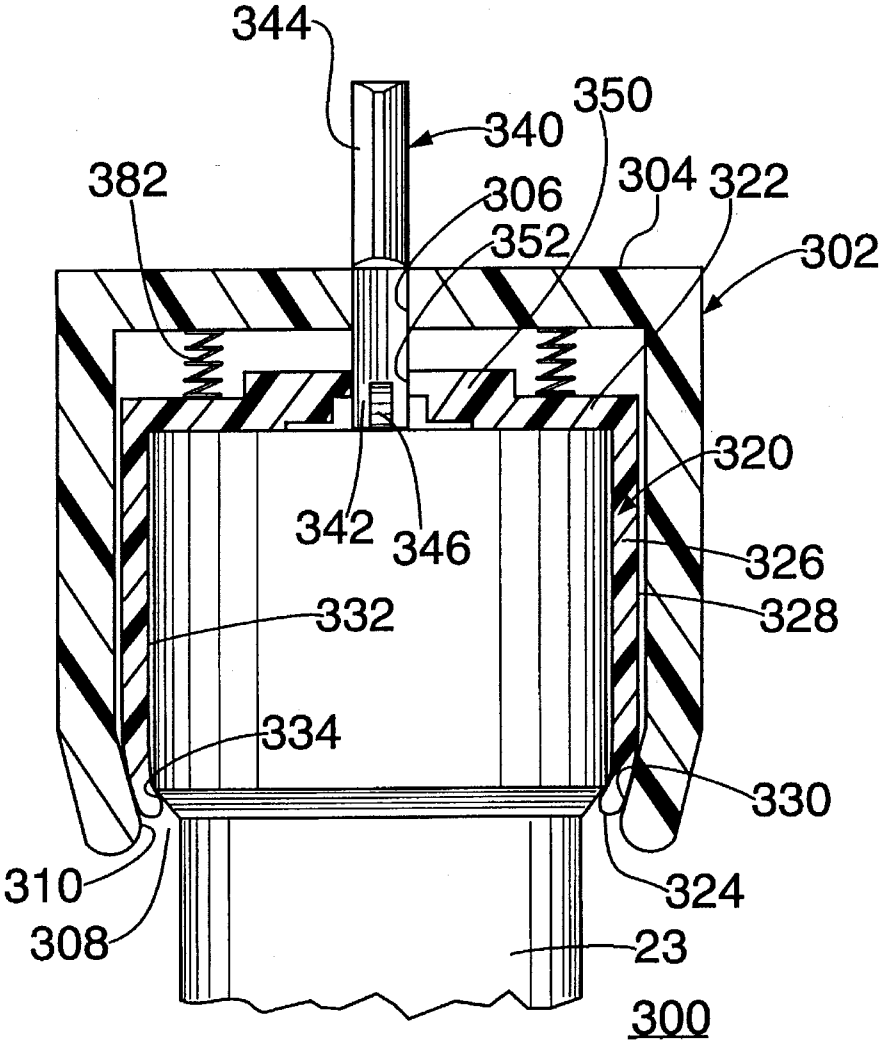
FIG. 20 is a side elevational view, in section, of still another embodiment of a lockable bottle cap retainer constructed in accordance with the concepts of the invention and shown installed and locked upon the neck of a bottle.

When the rotor 230 is turned 90° to the position shown in FIGS. 18 and 19, the rotor 230 transmits a downward force via pin 270 to the grip member 250 and a further force is applied by the expanding compression springs 280. The tapered portions 260 of fingers 254, ride tapered portion 212 and the tips 264 are forced inwardly to grip the bottle neck under the bottle neck rim. The device 200 will remain locked upon the bottle until the key 240 rotates the rotor a further 90°.

FIGS. 20 to 23 show a further mechanism for operating a grip member 320 of lockable bottle cap retainer 300. Body portion 302 is very similar to body portion 202 of device 200. Body portion 302 is circular, having a top member 304 with an aperture 306 centrally located therein. Adjacent open bottom 308 is an inwardly tapered portion 310.

Grip member 320, has a top member 322 and an open bottom 324. A number of resilient fingers 326 extend from top member 322 towards bottom 324. The outer surface 328 of fingers 326, are cylindrical for most of their height, and terminate near bottom 324 in an inclined surface 330 which engages inwardly tapered portion 310 of body portion 302. The interior surface 332 of fingers 328 is also generally cylindrical and terminate in an inwardly tapered tips 334 which generally describe a circle.

A key 340 has a central cylindrical body 342 which terminates in finger tab 344 at one end and operating arms 346 at the other. The operating arms 346 are intended to engage a series of camming surfaces on the interior of top member 322 of grip member 320. As the operating arms 346 move along the camming surfaces, the top member 322 of grip member 320 is moved towards and away from top 304 of body portion 302 with the result that the spacing at the tips 334 is changed to lock up or release the device 300 in a manner similar to device 200.

Top portion 322 has a central raised hub 350 with a bore 352 through it. The interior 354 of raised hub 350 has arranged thereon a series of camming surfaces 356, 358, 360 and 362. Each of the camming surfaces 356, 358, 360 and 362 begin at a low point marked L and progress steadily upwardly to a high point marked H and immediately drops back to the low point L. The device 300 is removed as the operating arms 346 approach the high point H. There is no need to keep device 300 unlocked since it can be applied to a bottle directly in its locked condition without use of key 340. Between each of the adjacent camming surfaces is placed flat rest or dwell positions 368, 370.

Figure 22:
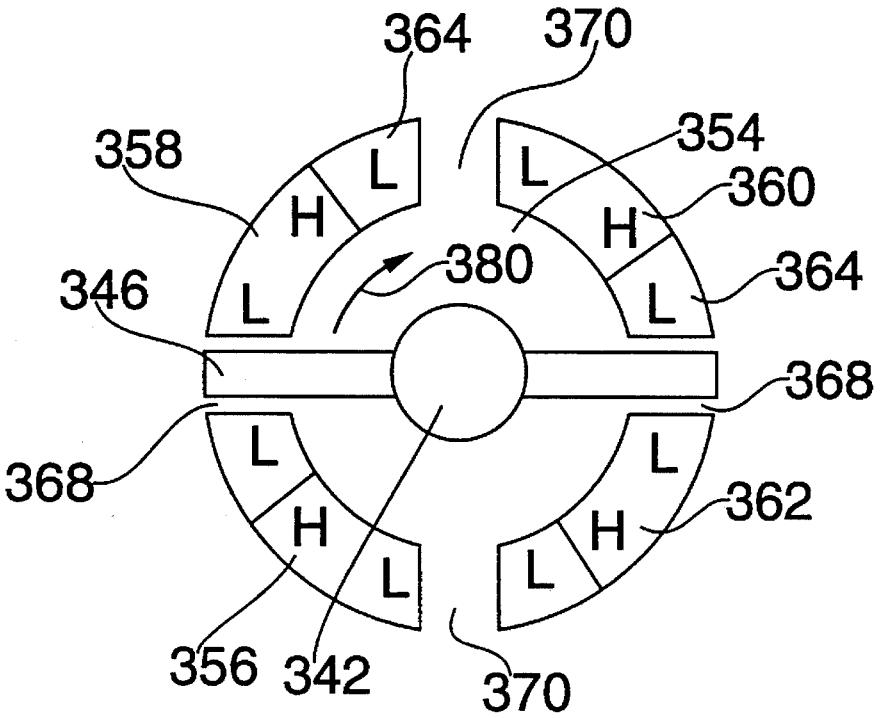
FIG. 22 is a bottom plan view of the cam arrangement of the locking finger portion of the device of FIG. 20.
Figure 23:
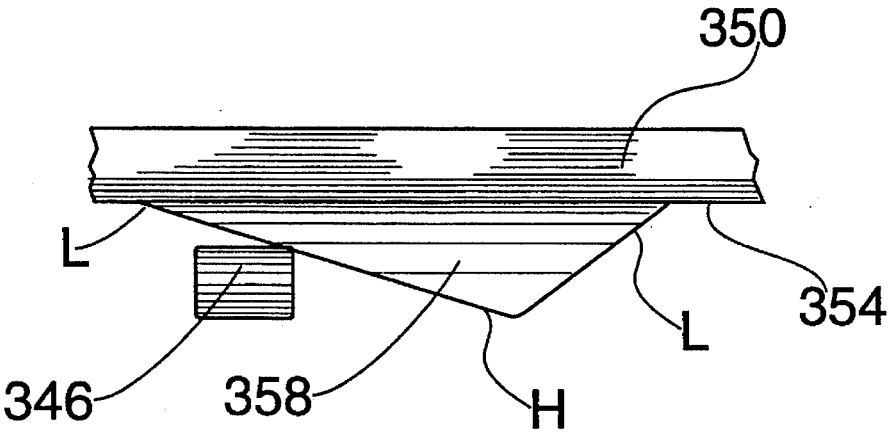
FIG. 23 is a fragmentary side elevational view of one of the cams of FIG. 22.
Figure 24:
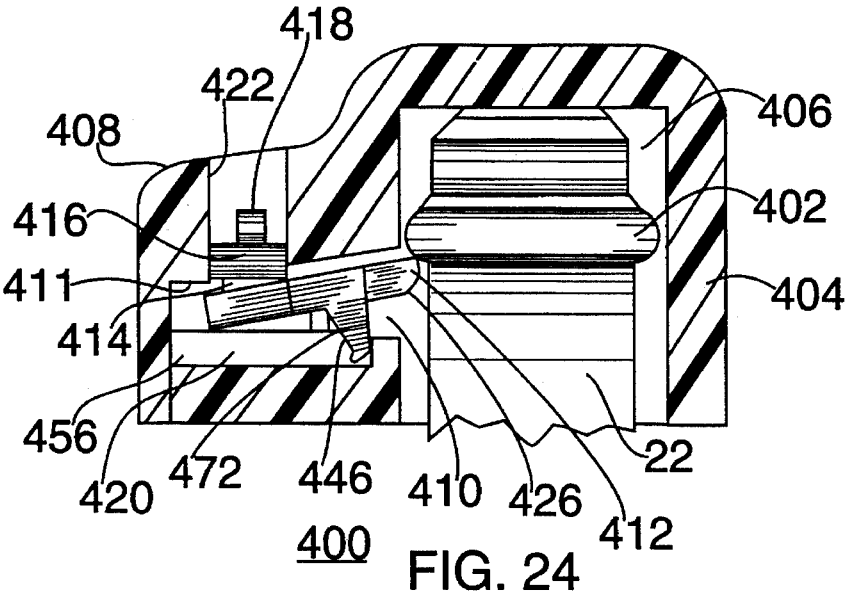
FIG. 24 is a side elevational view, partly in section, of yet another embodiment of a lockable bottle cap retainer constructed in accordance with the concepts of the invention and shown installed and locked upon the neck of a bottle.

The operating arms 346 are shown in FIG. 22 at the dwell positions 368 between camming surfaces 356, 358 and 360, 362. Similar dwell positions exist at 370 between camming surfaces 358 and 360 and between camming surfaces 362 and 356. When the operating arms 346 are at either of the dwell positions 368 or 370, the inwardly inclined surfaces 330 of fingers 326 are fully against inwardly tapered portion 310 of body portion 302 and inwardly tapered tips 334 are in a position to grip the ring about a bottle upon which device 300 is placed and prevent removal. The key 340 can be removed or inserted through body portion 302 onto the surface 354 of hub 350.

To permit the removal of the device 300 from the neck 23 of the bottle it is necessary to withdraw the tips 334 of fingers 326 from under the ring in a manner analogous to the operation of device 200 described above.

As the operating arms 346 are rotated in a clockwise direction as shown by arrow 380 in FIG. 22, the left-hand portion of arm 346 advances along camming surface 358 from low L towards high H. At the same time the right-hand portion of arm 346 advances along camming surface 362 from low L to high H. As can be seen from FIG. 23 this has the effect of lifting the hub 350 and with it top member 322 and the fingers 326. Compression springs 382 are compressed as top member 322 is moved towards top member 304 of body portion 302. The inclined surfaces 330 of fingers 326 move upwardly upon tapered portion 310 of body portion allowing the fingers 326 to increase the size of the described circle and thus remove tips 334 from under the bottle neck ring permitting device 300 to be removed.

Once the device 300 is unlocked and removed, the compression springs 382 force grip member 320 away from body part 302 will cause the downward slope of the camming surfaces from high H to low L to move along the operating arms 346 until they are seated in the adjacent dwell positions. This puts the device 300 in the locked condition, in which condition it can be applied to a bottle in the same manner as described with respect to device 200.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A device to prevent the unauthorized removal of a closure from the mouth of a bottle having an annular ting about its neck, said annular ring having a first face adjacent the mouth of the bottle and a second face spaced apart from said first face comprising:

a) a cap member having an open first end and a closed second end;

b) a bore within said cap member extending from said open first end towards said closed second end, said bore having a diameter in excess of the outside diameter of an annular ring of a bottle upon which said cap member is to be placed to permit such annular ring to enter said bore;

c) pawl means mounted adjacent said bore for engagement with the bottle neck adjacent said second face of an annular ring of a bottle upon which said cap member is placed to prevent the removal of said cap member from said bottle;

d) spring biasing means coupled to said pawl means to urge said pawl means into contact with said bottle neck adjacent said second face of said annular ring; and e) key means, selectively engageable with said pawl means, to move said pawl means out of engagement with said bottle neck adjacent said second face of said annular ring to per, nit the removal of said cap member from a bottle upon which said device is placed.

2. A device as claimed in claim 1, wherein said cap member closed second end engages the free face of a bottle closure to limit the length of the bottle neck which can be inserted into said bore of said cap member.

3. A device as claimed in claim 1, further comprising:

a) a locking mechanism housing coupled to said cap member;

b) means for rotatably mounting said pawl means to said locking mechanism housing; and c) a slot communicating between said housing and said cap member bore whereby said pawl means extends through said slot into said bore to engage said bottle neck adjacent said second face of an annular ring of a bottle upon which said cap member is placed.

4. A device as claimed in claim 3, wherein said housing has a recess therein into which said pawl means is rotated as it is removed from said bore to permit removal of said cap member from a bottle upon which said device is placed.

5. A device as claimed in claim 3, wherein said key means comprises:

a) a cylindrical shaft having a first end and a second end;

b) a tab adjacent said shaft first end adapted to be engaged to rotate said shaft; and c) a socket adjacent said shaft second end to engage a complementary element on said pawl means.

6. A device as claimed in claim 5, wherein said cap member has an exterior surface and further comprising:

a) a recess in said exterior surface of said cap member to accommodate at least a portion of said cylindrical shaft of said key means; and b) an aperture in said locking mechanism housing to receive said shaft second end.

7. A device as claimed in claim 5, further comprising:

a) key hub means on said pawl means having a predetermined shape; and b) said socket adjacent said shaft second end has a shape complementary to said predetermined shaped key hub means and is engageable with said predetermined shaped key hub means whereby said pawl means can be rotated by said key means out of engagement with bottle neck adjacent said second face of an annular ring of a bottle on which said cap member is placed to permit said cap member to be removed.

8. A device as claimed in claim 7, wherein said key hub means is in the shape of a triangle.

9. A device as claimed in claim 8, wherein said socket is in the shape of a triangle, and said key hub means fits fully within the periphery of said cylindrical shaft.

10. A device as claimed in claim 8, wherein said socket is in the shape of a triangle and the tips of said key hub means triangle beyond the periphery of said cylindrical shaft.

11. A device as claimed in claim 7, wherein said key hub means has a central hub and a tab radiating outwardly from said central hub.

12. A device as claimed in claim 11, wherein said socket has a central bore and a slot radiating outwardly from said central bore to receive said key hub means therein.

13. A device as claimed in claim 4, further comprising:

first stop means adjacent said slot to engage said pawl means to limit the amount of said pawl means extending through said slot into said bore of said cap member.

14. A device as claimed in claim 4, further comprising:

first stop means remote from said slot to engage said pawl means to limit the position of said pawl means with respect to said housing recess.

15. A device as claimed in claim 4, further comprising:

a) first stop means adjacent said slot to engage said pawl means to limit the amount of said pawl means extending through said slot into said bore of said cap member; and b) second stop means remote from said slot to engage said pawl means to the position of said pawl means with respect to said housing recess.

16. A device as claimed in claim 4, wherein said spring biasing means is a compression spring connected between said pawl means and said housing recess.

17. A device as claimed in claim 1 wherein:

a) said pawl means has a first surface and a second surface and an end surface connected there between; and b) a portion of the jointure of said second surface with said end surface is tapered to cause said pawl means to be displaced from said bore in said cap member as said tapered surface engages the first face of an annular ring of a bottle upon which said cap member is placed to permit said cap member to be fully installed on such bottle.

18. A device as claimed in claim 17, wherein said first surface of said pawl means engages the neck of said bottle neck adjacent said second face of the bottle annular ring after such annular ring passes said pawl means to prevent withdrawal of said cap member from the bottle on which said cap member is installed.

19. A device as claimed in claim 1, further comprising:

a) a locking mechanism housing coupled to said cap member;

b) means for slideably mounting said pawl means to said locking mechanism housing; and c) a slot communicating between said housing and said cap member bore whereby said pawl means extends through said slot into said bore to engage said bottle neck adjacent said second face of an annular ring of a bottle upon which said cap member is placed.

20. A device as claimed in claim 19, wherein said housing has a recess therein into which said pawl means slides as it is removed from said bore to permit removal of said cap member from a bottle upon which said device is placed.

21. A device as claimed in claim 19 wherein said key means comprises:

a) a cylindrical shaft having a first end and a second end;

b) a tab adjacent said shaft first end adapted to be engaged to rotate said shaft; and c) a socket adjacent said shaft second end to engage a complementary element on said pawl means.

22. A device as claimed in claim 21, further comprising:

a) key hub means on said pawl means having a predetermined shape; and b) said socket adjacent said shaft second end has a shape complementary to said predetermined shaped key hub means whereby said pawl means can be slid by said key means out of engagement with said bottle neck adjacent said second face of an annular ring of a bottle on which said cap member is placed to permit said cap member to be removed.

23. A device as claimed in claim 22, wherein said key hub means is in the shape of a triangle.

24. A device as claimed in claim 23, wherein said socket is in the shape of a triangle, and said key hub means fits fully within the periphery of said cylindrical shaft.

25. A device as claimed in claim 23, wherein said socket is in the shape of a triangle and the tips of said key hub means triangle extend beyond the periphery of said cylindrical shaft.

26. A device as claimed in claim 22, wherein said key hub means has a central hub and a tab radiating outwardly from said central hub.

27. A device as claimed in claim 26, wherein said socket has a central bore and a slot radiating outwardly from said central bore to receive said key hub means therein.

28. A device as claimed in claim 20, wherein said recess has a first portion having a width greater than the width of said pawl and a second portion of lesser width than said first portion located on a common center line and connected to said first portion; the transition from said first portion to said second portion forming a pair of recess shoulders one to each side of said center line.

29. A device as claimed in claim 28, wherein:

a) said pawl has a first body portion having a predetermined width adapted to slide within said first portion of said recess and a second body portion of a second predetermined width, located on a common center line and connected to said first body portion, and adapted to slide within said second portion of said recess, the transition from said first body portion to said second body portion forming a pair of pawl shoulders, one to each side of said center line; and b) a pair of compression springs, each spring mounted between one of said recess shoulders and a corresponding one of said pawl shoulders whereby said pawl is urged to slideably pass through said slot into said cap member bore to engage said bottle neck adjacent said second face of an annular ring of a bottle upon which said cap member is placed.

30. A device as claimed in claim 29, further comprising: an additional compression spring extending between said recess floor and said pawl to urge said pawl towards said annular ring second face along said bottle neck.

31. A device as claimed in claim 29, further comprising:

a) first rib means extending generally perpendicular to the top surface of said pawl and across the width of said second body portion adjacent the end of said second body portion remote from the junction with said first body portion;

b) rotatable cam means having a first lobe and a second lobe, each of said lobes arranged to separately engage said first rib means;

c) the engagement of said first lobe with said first rib means permitting said compression springs to slide said pawl through said slot into said cap member bore; and d) the movement of said cam means from said first lobe engaging said first rib means to said second lobe engaging said first rib means slideably retracts said pawl from said cap member bore and compresses said compression springs.

32. A device as claimed in claim 31, further comprising:

a) a shaft coupled to said cam means for rotating said cam means between said first lobe contacting said first rib means and said second lobe means contacting said first rib means and back again;

b) key hub means coupled to said shaft;

c) an aperture through said locking mechanism housing by which access is permitted to said key hub means; and d) said key means arranged to engage said key hub means to rotate said shaft to position one of said first and second lobes to engage said first rib means.

33. A device as claimed in claim 20, wherein said sprig biasing means has a spring member to urge said pawl means out of said housing through said slot into engagement with said bottle neck.

34. A device as claimed in claim 33, wherein said spring member is a pair of bowed arms on a pawl biasing member.

35. A device as claimed in claim 34, wherein said pair of bowed arms operate along the longitudinal axis of said pawl biasing member.

36. A device as claimed in claim 20, wherein said spring biasing means has a first spring member to urge said pawl means out of said housing through said slot into engagement with said bottle neck, and a second spring member to urge said pawl means along said bottle neck to engage the juncture between said bottle neck and an annular ring about said bottle neck.

37. A device as claimed in claim 36, wherein said first sprig member is a first pair of bowed arms on a pawl biasing member to operate along the longitudinal axis of said pawl biasing member and wherein said second spring member is a second pair of bowed arms on said pawl biasing member to operate in a plane transverse to the longitudinal axis of said pawl biasing member.

* * * * *